US009510422B2

(12) United States Patent
Koshimizu et al.

(10) Patent No.: US 9,510,422 B2
(45) Date of Patent: Nov. 29, 2016

(54) LIGHT-EMITTING DIODE DRIVING APPARATUS

(71) Applicant: Kabushiki Kaisha Tokai Rika Denki Seisakusho, Aichi (JP)

(72) Inventors: Toru Koshimizu, Aichi (JP); Masahiro Inoue, Aichi (JP)

(73) Assignee: KABUSHIKI KAISHA TOKAI RIKA DENKI SEISAKUSHO, Aichi (JP)

( * ) Notice: Subject to any disclaimer, the term of this patent is extended or adjusted under 35 U.S.C. 154(b) by 0 days.

(21) Appl. No.: 15/089,951

(22) Filed: Apr. 4, 2016

(65) Prior Publication Data

US 2016/0309551 A1 Oct. 20, 2016

(30) Foreign Application Priority Data

Apr. 15, 2015 (JP) ..... 2015-083195

(51) Int. Cl.
*H05B 39/00* (2006.01)
*H05B 33/08* (2006.01)

(52) U.S. Cl.
CPC ..... *H05B 33/089* (2013.01); *H05B 33/0815* (2013.01); *H05B 33/0845* (2013.01)

(58) Field of Classification Search
CPC .. H05B 39/09; H05B 41/2853; H05B 41/36; H05B 33/0815; H05B 33/0851; H05B 6/06; H05B 41/282; H05B 41/3925; H01L 27/14643; H01L 27/148; H03F 2203/45101; H03F 2203/45138; H03F 3/087; H03F 3/451
See application file for complete search history.

(56) References Cited

U.S. PATENT DOCUMENTS 7,734,193 B2 * 6/2010 Day ..... H03F 1/26 398/202
8,487,549 B2 * 7/2013 Hsieh ..... H05B 33/0818 315/185 R
2011/0121870 A1 * 5/2011 Morino ..... H03K 17/22 327/143
2012/0161737 A1 6/2012 Yamauchi
2012/0242249 A1 9/2012 Yu et al.
2014/0210353 A1 7/2014 Chen

FOREIGN PATENT DOCUMENTS

JP 2007-305929 11/2007

OTHER PUBLICATIONS

Extended European Search Report, mailed Sep. 22, 2016, from the European Patent Office in the corresponding European Patent Application No. 16000770.4.

* cited by examiner

*Primary Examiner* — Monica C King
(74) *Attorney, Agent, or Firm* — Greenblum & Bernstein, P.L.C.

(57) ABSTRACT

Provided is a light-emitting diode driving apparatus, including: a switching transistor which becomes an on-state or an off-state in response to a pulse width modulation signal; a light-emitting diode electrically connected with a second terminal of the switching transistor; a first comparison circuit which outputs a first voltage depending on a comparison result between a first input voltage corresponding to a voltage applied to the light-emitting diode and a first threshold voltage; a second comparison circuit which outputs a second voltage depending on a comparison result between a second input voltage corresponding to a voltage applied to the light-emitting diode and a second threshold voltage; and a signal processing circuit which detects a failure in the light-emitting diode on the basis of an output state of the pulse width modulation signal, the first voltage, the second voltage and a third voltage on the second terminal side of the switching transistor.

19 Claims, 5 Drawing Sheets

LIGHT-EMITTING DIODE DRIVING APPARATUS

CROSS REFERENCE TO RELATED APPLICATION(S)

This application is based upon and claims benefit of priority from Japanese Patent Application No. 2015-083195, filed on Apr. 15, 2015, the entire contents of which are incorporated herein by reference.

BACKGROUND

The present invention relates to a light-emitting diode driving apparatus.

A technology for detecting a failure in a light-emitting diode is developed. As one example of a technology for detecting an open-circuit failure of the light-emitting diode constituting a light-emitting diode array in which a plurality of light-emitting diodes is connected in series, the technology described, for example, in JP 2007-305929A may be given.

SUMMARY

In a case where the technology described, for example, in JP 2007-305929A is used, the failure in the light-emitting diode is detected by detecting that an electric current ceases to flow in a resistor which is connected to the light-emitting diode. Therefore, in a case where the technology described, for example, in JP 2007-305929A is used, the open-circuit failure in the light-emitting diode can be detected while the light-emitting diode is emitting light by being driven by pulse width modulation (hereinafter, referred to as "PWM" as the case may be).

Here, the failure in the light-emitting diode is not limited to the open-circuit failure and a short-circuit failure would occur. However, the short-circuit failure in the light-emitting diode cannot be detected even when the technology described, for example, in JP 2007-305929A is used.

In view of the above-mentioned circumstances, it is desirable to provide a novel and improved light-emitting diode driving apparatus capable of detecting the failure having occurred in the light emitting diode which emits light by being driven by pulse width modulation.

According to an aspect of the present invention, there is provided a light-emitting diode driving apparatus, including: a switching transistor which has a first terminal electrically connected with a power source and becomes an on-state or an off-state in response to a pulse width modulation signal applied to a control terminal; a light-emitting diode which is electrically connected with a second terminal of the switching transistor and emits light when an electric current flows; a first comparison circuit which is electrically connected between the switching transistor and the light-emitting diode and outputs a first voltage depending on a result of comparison between a first input voltage corresponding to a voltage applied to the light-emitting diode and a first threshold voltage; a second comparison circuit which is electrically connected between the switching transistor and the light-emitting diode and outputs a second voltage depending on a result of comparison between a second input voltage corresponding to a voltage applied to the light-emitting diode and a second threshold voltage different from the first threshold voltage; and a signal processing circuit which detects a failure having occurred in the light-emitting diode on the basis of an output state of the pulse width modulation signal, the first voltage, the second voltage and a third voltage on the second terminal side of the switching transistor.

With such a configuration, it is possible to detect the failure (the open-circuit failure or the short-circuit failure) having occurred in the light-emitting diode which emits light by being driven by pulse width modulation.

The signal processing circuit may detect occurrence of each of a short-circuit failure in the light-emitting diode and an open-circuit failure in the light-emitting diode on the basis of the output state of the pulse width modulation signal and a combination of respective voltage levels of the first voltage, the second voltage and the third voltage.

The signal processing circuit may further detect a failure which has occurred in the switching transistor on the basis of the output state of the pulse width modulation signal, the first voltage, the second voltage and the third voltage.

The signal processing circuit may detect occurrence of each of a short-circuit failure in the switching transistor and an open-circuit failure in the switching transistor on the basis of the output state of the pulse width modulation signal and a combination of respective voltage levels of the first voltage, the second voltage and the third voltage.

The output state of the pulse width modulation signal may be a state where the pulse width modulation signal for making the light-emitting diode emit light is output or a state where the pulse width modulation signal for stopping light emission of the light-emitting diode is output.

The signal processing circuit may output the pulse width modulation signal.

A signal output circuit which generates and outputs the pulse width modulation signal may be further included. The signal processing circuit may detect a failure having occurred in the light-emitting diode on the basis of the output state of the pulse width modulation signal in the signal output circuit.

According to an aspect of the present invention described above, it is possible to detect the failure (the open-circuit failure or the short-circuit failure) having occurred in the light-emitting diode which emits light by being driven by pulse width modulation.

DETAILED DESCRIPTION OF THE EMBODIMENT(S)

Figure 1:
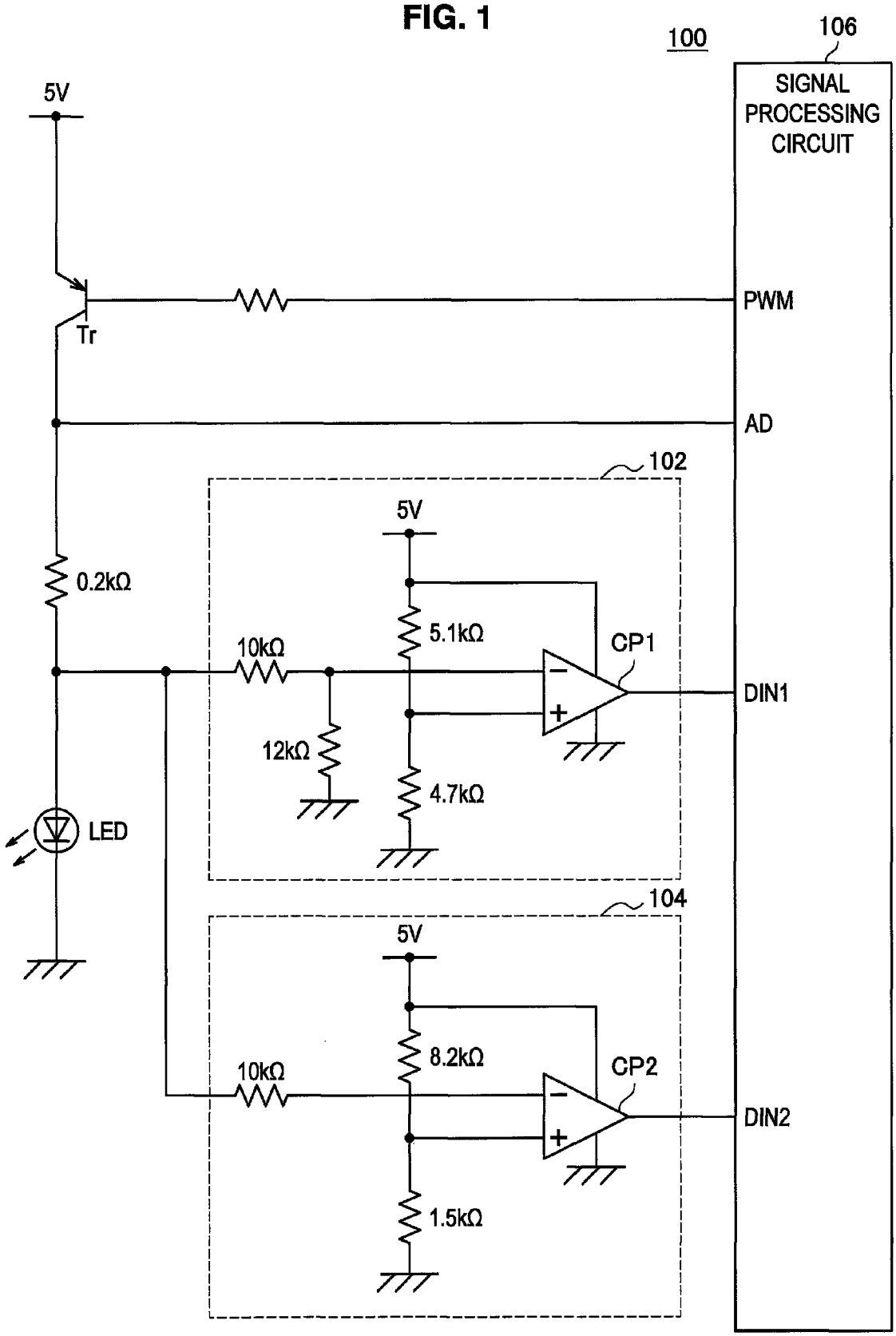
FIG. 1 is an explanatory diagram illustrating one example of a configuration of a light-emitting diode driving apparatus according to an embodiment of the present invention.

Hereinafter, referring to the appended drawings, preferred embodiments of the present invention will be described in detail. It should be noted that, in this specification and the appended drawings, structural elements that have substantially the same function and structure are denoted with the same reference numerals, and repeated explanation thereof is omitted.

In addition, in the following, "one structural element and another structural element are connected together" means that "one structural element concerned and another structural element concerned are electrically connected without intervention of a further another structural element" or that "one structural element concerned and another structural element concerned are electrically connected with intervention of the further another structural element".

(Light-Emitting Diode Driving Apparatus According to Embodiment of the Present Invention)

[1] One Example of a Configuration of a Light-Emitting Diode Driving Apparatus According to an Embodiment of the Present Invention FIG. 1 is an explanatory diagram illustrating one example of a configuration of a light-emitting diode driving apparatus 100 according to an embodiment of the present invention.

The light-emitting diode driving apparatus 100 includes, for example, a switching transistor Tr, a light-emitting diode LED, a comparison circuit 102, a comparison circuit 104, and a signal processing circuit 106.

The switching transistor Tr has a first terminal connected with a power source and has a second terminal connected with each of the light-emitting diode LED, the comparison circuit 102, the comparison circuit 104 and the signal processing circuit 106. The switching transistor Tr becomes an on-state (a conducted state) or an off-state (a not-conducted state) in response to a signal level (a voltage level) of a pulse width modulation signal applied to a control terminal.

Here, examples of the switching transistor Tr include a bipolar transistor, and a field-effect transistor (FET) such as a thin film transistor (TFT) and a metal-oxide-semiconductor field effect transistor (MOSFET).

Although one example in which the switching transistor Tr according to an embodiment of the present invention is a PNP type bipolar transistor is illustrated in FIG. 1, the switching transistor Tr according to an embodiment of the present invention is not limited to the above-mentioned example. For example, the switching transistor Tr according to an embodiment of the present invention may be an NPN type bipolar transistor, a P-channel type TFT or an N-channel type TFT. Further, the switching transistor Tr according to an embodiment of the present invention may be any circuit element as long as it is possible for the circuit element to serve as a switching element which becomes the on-state or the off-state in response to the pulse width modulation signal.

In the following, a case where the switching transistor Tr according to an embodiment of the present invention is a PNP type bipolar transistor, that is, a case where the first terminal of the switching transistor Tr serves as an emitter, the second terminal serves as a collector and the control terminal serves as a base will be given by way of example. Incidentally, in the light-emitting diode driving apparatus according to an embodiment of the present invention, there may be a case where the first terminal of the switching transistor Tr according to an embodiment of the present invention serves as the collector and the second terminal serves as the emitter depending on, for example, a power source voltage which is supplied thereto, a circuit configuration and so forth.

Examples of the power source to be connected with the switching transistor Tr include an internal power source that the light-emitting diode driving apparatus 100 includes such as a battery, and an external power source of the light-emitting diode driving apparatus 100.

The light-emitting diode LED is connected with the second terminal of the switching transistor Tr and emits light when an electric current flows. Examples of the light-emitting diode LED include an organic light-emitting diode and an inorganic light-emitting diode.

Incidentally, although one example in which an anode of the light-emitting diode LED is connected with the second terminal of the switching transistor Tr is illustrated in FIG. 1, the configuration of the light-emitting diode driving apparatus according to an embodiment of the present invention is not limited to the above-mentioned configuration. The light-emitting diode driving apparatus according to an embodiment of the present invention may have, for example, a configuration in which a cathode of the light-emitting diode LED is connected with the second terminal of the switching transistor Tr depending on the supplied power source voltage and so forth.

The comparison circuit 102 is a first comparison circuit that the light-emitting diode driving apparatus 100 includes and is connected between the switching transistor Tr and the light-emitting diode LED.

The comparison circuit 102 includes a comparator CP1 which compares a voltage (a first input voltage corresponding to a voltage applied to the light-emitting diode LED) which is input into an inverting input terminal (+) of the comparator CP1 with a first threshold voltage which is input into a non-inverting input terminal (+) of the comparator CP1. Then, the comparator CP1 of the comparison circuit 102 outputs a first voltage depending on a result of the comparison. Incidentally, the comparison circuit 102 may also have a configuration in which the first input voltage is input into the non-inverting input terminal (−) of the comparator CP1 and the first threshold voltage is input into the inverting input terminal (−) of the comparator CP1.

Here, the example in which the first threshold voltage is 2.5 [V] is illustrated in FIG. 1. The first threshold voltage is set to 2.5 [V] and thereby the voltage level of the first voltage becomes a high level not depending on the state of the switching transistor Tr in the light-emitting diode driving apparatus 100 illustrated in FIG. 1.

Incidentally, the first threshold voltage in the comparison circuit 102 is not limited to 2.5 [V]. It is possible to set the first threshold voltage in the comparison circuit 102 depending on, for example, the power source voltage supplied from the power source, the type of the light-emitting diode LED that the light-emitting diode driving apparatus 100 includes and so forth.

The comparison circuit 104 is a second comparison circuit that the light-emitting diode driving apparatus 100 includes and is connected between the switching transistor Tr and the light-emitting diode LED. The comparison circuit 104 is connected in parallel with the comparison circuit 102, for example, as illustrated in FIG. 1.

The comparison circuit 104 includes a comparator CP2 which compares a voltage (a second input voltage corresponding to a voltage which is applied to the light-emitting diode LED) which is input into an inverting input terminal (−) of the comparator CP2 with a second threshold voltage which is input into a non-inverting input terminal (+) of the comparator CP2. Then, the comparator CP2 of the comparison circuit 104 outputs a second voltage depending on a result of the comparison. Incidentally, the comparison circuit 104 may also have a configuration in which the second input voltage is input into the non-inverting input terminal (+) of the comparator CP2 and the second threshold voltage is input into the inverting input terminal (−) of the comparator CP2.

Here, the second threshold voltage is a voltage which is different from the first threshold voltage in magnitude. The example in which the second threshold voltage is 0.7 [V] is illustrated in FIG. 1. The second threshold voltage is set to 0.7 [V] and thereby the voltage level of the second voltage varies between the high level and a low level depending on the state (the on-state or the off-state) of the switching transistor Tr in the light-emitting diode driving apparatus 100 illustrated in FIG. 1.

Incidentally, the second threshold voltage in the comparison circuit 104 is not limited to 0.7 [V]. It is possible to set the second threshold voltage in the comparison circuit 104 depending on, for example, the power source voltage supplied from the power source, the type of the light-emitting diode LED that the light-emitting diode driving apparatus 100 includes and so forth.

In the following, a case where the first threshold voltage is 2.5 [V] and the second threshold voltage is 0.7 [V], that is, a case where the first threshold voltage is higher than the second threshold voltage will be given by way of example. Incidentally, even in a case where the second threshold voltage is higher than the first threshold voltage such as, for example, a case where the second threshold voltage is 2.5 [V] and the first threshold voltage is 0.7 [V], it is possible for the light-emitting diode driving apparatus 100 to exhibit the same effects as those obtained in a case where the first threshold voltage is higher than the second threshold voltage by later described processing to be performed by the signal processing circuit 106.

The signal processing circuit 106 detects the failure having occurred in the light-emitting diode LED on the basis of an output state of the pulse width modulation signal, the first voltage, the second voltage and a voltage (hereinafter, referred to as a third voltage) on the second terminal side of the switching transistor Tr.

Examples of the signal processing circuit 106 include a processor such as a central processing unit (CPU) and a micro-controller.

In FIG. 1, a voltage to be input into a terminal DIN1 of the signal processing circuit 106 corresponds to the first voltage and a voltage to be input into a terminal DIN2 of the signal processing circuit 106 corresponds to the second voltage. In addition, in FIG. 1, a voltage to be input into a terminal AD of the signal processing circuit 106 corresponds to the third voltage.

Examples of the output state of the pulse width modulation signal include a state where a pulse width modulation signal for making the light-emitting diode LED emit light is being output and a state where another pulse width modulation signal for stopping light emission of the light-emitting diode LED is being output.

Here, the pulse width modulation signal for making the light-emitting diode LED of the light-emitting diode driving apparatus 100 illustrated in FIG. 1 emit light is a pulse width modulation signal which is, for example, less than 100[%] in duty ratio. In addition, the pulse width modulation signal for stopping light emission of the light-emitting diode LED in the light-emitting diode driving apparatus 100 illustrated in FIG. 1 is a pulse width modulation signal which is, for example, 100[%] in duty ratio.

Incidentally, the pulse width modulation signal for making the light-emitting diode LED according to an embodiment of the present invention emit light and the pulse width modulation signal for stopping light emission of the light-emitting diode LED according to an embodiment of the present invention are not limited to the above-mentioned examples. For example, in a case where the switching transistor Tr is the NPN type bipolar transistor, an example of the pulse width modulation signal for making the light-emitting diode LED emit light includes a pulse width modulation signal which is larger than 0 [%] in duty ratio. In addition, in a case where the switching transistor Tr is the NPN type bipolar transistor, an example of the pulse width modulation signal for stopping light emission of the light-emitting diode LED includes a pulse width modulation signal which is 0 [%] in duty ratio.

For example, in a case where the signal processing circuit 106 has a function of generating and outputting the pulse width modulation signal, the signal processing circuit 106 uses the output state of the pulse width modulation signal by the above-mentioned function for detection of the failure in the light-emitting diode LED (and for later described detection of the failure in the switching transistor Tr).

In addition, for example, in a case where the pulse width modulation signal is output from the external device of the light-emitting diode driving apparatus 100, or any one of other structural elements (for example, a later described signal output circuit) that the light-emitting diode driving apparatus 100 includes, the signal processing circuit 106 uses the output state of the pulse width modulation signal indicated by data which is acquired from the external device concerned and so forth and indicates the output state of the pulse width modulation signal, for detection of the failure in the light-emitting diode LED (and for later described detection of the failure in the switching transistor Tr).

Here, one example of the data indicating the output state of the pulse width modulation signal according to an embodiment of the present invention is a "flag which indicates the state where the pulse width modulation signal for making the light-emitting diode LED emit light is being output or the state where the pulse width modulation signal for stopping light emission of the light-emitting diode LED is being output". Incidentally, the data indicating the output state of the pulse width modulation signal according to an embodiment of the present invention is not limited to the above-mentioned flag and may be data of any format capable of indicating the state where the pulse width modulation signal for making the light-emitting diode LED emit light is being output or the state where the pulse width modulation signal for stopping light emission of the light-emitting diode LED is being output.

The signal processing circuit 106 detects occurrence of each of the short-circuit failure in the light-emitting diode LED and the open-circuit failure in the light-emitting diode LED on the basis of the "output state of the pulse width modulation signal" and a "combination of respective voltage levels of the first voltage, the second voltage and the third voltage".

More specifically, the signal processing circuit 106 detects that the "combination of the respective voltage levels of the first voltage, the second voltage and the third voltage" is different from a combination of the respective voltage levels when no failure occurs in the light-emitting diode LED, for example, in a case where the "output state of the pulse width modulation signal" is the state where the pulse width modulation signal for making the light-emitting diode LED emit light is being output and thereby detects the failure in the light-emitting diode LED. In addition, the signal processing circuit 106 discriminates the difference between the "combination of the respective voltage levels of the first voltage, the second voltage and the third voltage" and the combination of the respective voltage levels when no failure occurs in the light-emitting diode LED and thereby detects occurrence of each of the short-circuit failure in the light-emitting diode LED and the open-circuit failure in the light-emitting diode LED.

In addition, it is also possible for the signal processing circuit 106 to further detect the failure which has occurred in the switching transistor Tr on the basis of the output state of the pulse width modulation signal, the first voltage, the second voltage and the third voltage.

The signal processing circuit 106 detects occurrence of each of the short-circuit failure in the switching transistor Tr and the open-circuit failure in the switching transistor Tr on the basis of the "output state of the pulse width modulation signal" and the "combination of the respective voltage levels of the first voltage, the second voltage and the third voltage".

More specifically, the signal processing circuit 106 detects that the "combination of the respective voltage levels of the first voltage, the second voltage and the third voltage" is different from the combination when no failure occurs in the switching transistor Tr, for example, in a case where the "output state of the pulse width modulation signal" is the state where the pulse width modulation signal for stopping light emission of the light-emitting diode LED is being output and thereby detects the short-circuit failure in the switching transistor Tr. In addition, the signal processing circuit 106 may discriminate the difference between the "combination of the respective voltage levels of the first voltage, the second voltage and the third voltage" and the combination when no failure occurs in the switching transistor Tr and thereby may detect occurrence of the short-circuit failure in the switching transistor Tr.

In addition, in a case where the "output state of the pulse width modulation signal" is the state where the pulse width modulation signal for making the light-emitting diode LED emit light is being output, the signal processing circuit 106 detects, for example, that the "combination of the respective voltage levels of the first voltage, the second voltage and the third voltage" is different from the combination when no failure occurs in the switching transistor Tr and thereby detects the failure in the switching transistor Tr. In addition, the signal processing circuit 106 discriminates the difference between the "combination of the respective voltage levels of the first voltage, the second voltage and the third voltage" and the combination when no failure occurs in the switching transistor Tr and thereby detects occurrence of each of the short-circuit failure in the switching transistor Tr and the open-circuit failure in the switching transistor Tr.

In the following, specific examples of detection of the failure in each of the switching transistor Tr and the light-emitting diode LED in the signal processing circuit 106 illustrated in FIG. 1 will be given.

Figure 2:
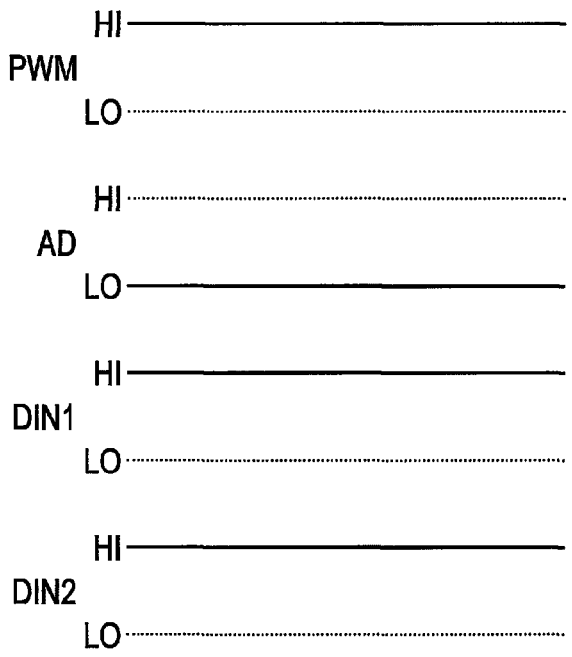
FIG. 2 is an explanatory diagram for explaining a first example of failure detection performed by a signal processing circuit that the light-emitting diode driving apparatus according to an embodiment of the present invention includes.
Figure 3:
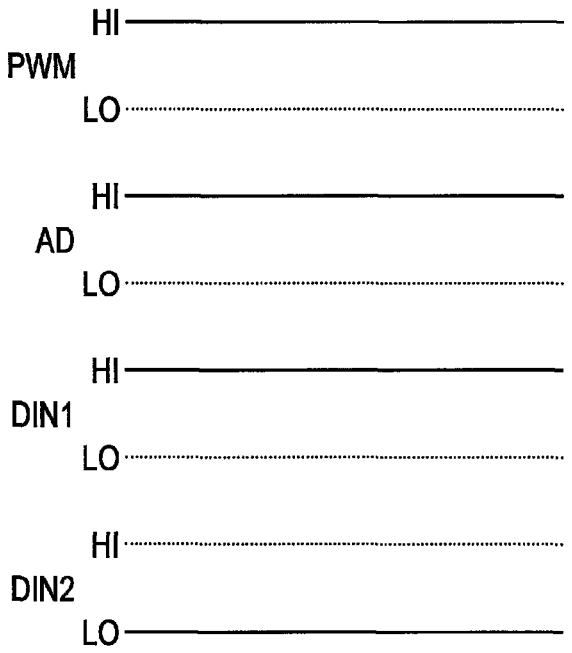
FIG. 3 is an explanatory diagram for explaining the first example of failure detection performed by the signal processing circuit that the light-emitting diode driving apparatus according to an embodiment of the present invention includes.

[1-1] First Example of Failure Detection in the Signal Processing Circuit 106: One Example of the Case where the Output State of the Pulse Width Modulation Signal is the State where the Pulse Width Modulation Signal for Stopping Light Emission of the Light-Emitting Diode LED is being Output Each of FIG. 2 and FIG. 3 is an explanatory diagram for explaining the first example of failure detection in the signal processing circuit 106 that the light-emitting diode driving apparatus 100 according to an embodiment of the present invention includes. As indicated in PWM in FIG. 2 and FIG. 3, FIG. 2 and FIG. 3 each illustrate the case where the output state of the pulse width modulation signal is the state where the pulse width modulation signal for stopping light emission of the light-emitting diode LED is being output.

FIG. 2 illustrates the voltage levels of the voltages (the third voltage, the first voltage and the second voltage) to be respectively input into the terminal AD, the terminal DIN1 and the terminal DIN2 of the signal processing circuit 106 in a case where no short-circuit failure occurs in the switching transistor Tr. That is, FIG. 2 illustrates the normal "combination of the respective voltage levels of the first voltage, the second voltage and the third voltage" in a case where the output state of the pulse width modulation signal is the state where the pulse width modulation signal for stopping light emission of the light-emitting diode LED is being output.

In addition, FIG. 3 illustrates the voltage levels of the voltages (the third voltage, the first voltage and the second voltage) to be respectively input into the terminal AD, the terminal DIN1 and the terminal DIN2 of the signal processing circuit 106 in a case where the short-circuit failure is occurring in the switching transistor Tr.

Here, the signal processing circuit 106 obtains the voltage level at the terminal AD illustrated in FIG. 2 and FIG. 3, for example, by converting the third voltage to be input into the terminal AD by an analog-to-digital (AD) converter that the signal processing circuit 106 includes. In addition, since the voltages to be respectively input into the terminal DIN1 and the terminal DIN2 are voltages which are respectively output from the comparators CP1 and CP2, the signal processing circuit 106 uses, for example, the voltages to be respectively input into the terminal DIN1 and the terminal DIN2 as they are without converting them by the AD converter. In the following, the same also applies to other examples of failure detection in the signal processing circuit 106.

In a case where a short-circuit has occurred between the emitter and collector (between the first terminal and second terminal) of the switching transistor Tr and the short-circuit failure has occurred in the switching transistor Tr, the switching transistor Tr becomes the on-state not depending on the pulse width modulation signal to be applied to the control terminal. Accordingly, in a case where the short-circuit failure has occurred in the switching transistor Tr, as illustrated in FIG. 3, the voltage level of the third voltage to be input into the terminal AD and the voltage level of the second voltage to be input into the terminal DIN2 are different from the voltage levels illustrated in FIG. 2.

Specifically, in a case where the short-circuit failure has occurred in the switching transistor Tr when the output state of the pulse width modulation signal is the state where the pulse width modulation signal for stopping light emission of the light-emitting diode LED is being output, the switching transistor Tr becomes the on-state and thereby the voltage level of the third voltage to be input into the terminal AD and the voltage level of the second voltage to be input into the terminal DIN2 become voltage levels as follows.

The voltage level of the third voltage to be input into the terminal AD becomes a high level.

The voltage level of the second voltage to be output from the comparison circuit 104 in which the threshold voltage is lower than that of the comparison circuit 102 becomes a low level.

For example, in a case where the "output state of the pulse width modulation signal" is the state where the pulse width modulation signal for stopping light emission of the light-emitting diode LED is being output, the signal processing circuit 106 determines that the short-circuit failure has occurred in the switching transistor Tr when the "combination of the respective voltage levels of the first voltage, the second voltage and the third voltage" is the combination illustrated in FIG. 3. The signal processing circuit 106 detects the short-circuit failure in the switching transistor Tr by determining occurrence of the short-circuit failure in the switching transistor Tr, for example, in the above-mentioned manner.

[1-2] Second Example of Failure Detection in the Signal Processing Circuit 106: One Example of the Case where the Output State of the Pulse Width Modulation Signal is the State where the Pulse Width Modulation Signal for Making the Light-Emitting Diode LED Emit Light is being Output Each of FIG. 4 to FIG. 8 is an explanatory diagram for explaining a second example of failure detection in the signal processing circuit 106 that the light-emitting diode driving apparatus 100 according to an embodiment of the present invention includes. As indicated in PWM in FIG. 4 to FIG. 8, FIG. 4 to FIG. 8 each illustrate the case where the output state of the pulse width modulation signal is the state where the pulse width modulation signal for making the light-emitting diode LED emit light is being output.

Figure 4:
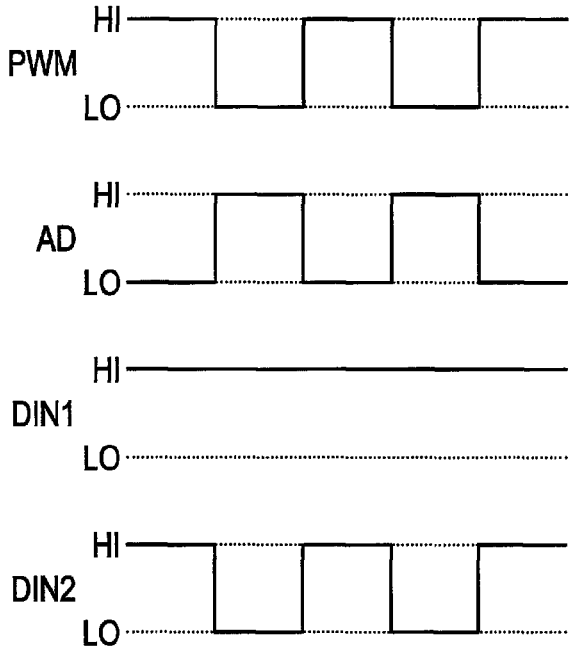
FIG. 4 is an explanatory diagram for explaining a second example of failure detection performed by the signal processing circuit that the light-emitting diode driving apparatus according to an embodiment of the present invention includes.

FIG. 4 illustrates the voltage levels of the voltages (the third voltage, the first voltage and the second voltage) to be respectively input into the terminal AD, the terminal DIN1 and the terminal DIN2 of the signal processing circuit 106 in a case where no failure occurs in the switching transistor Tr and the light-emitting diode LED. That is, FIG. 4 illustrates the normal "combination of the respective voltage levels of the first voltage, the second voltage and the third voltage" in a case where the output state of the pulse width modulation signal is the state where the pulse width modulation signal for making the light-emitting diode LED emit light is being output.

[1-2-1] Detection of the Short-Circuit Failure in the Switching Transistor Tr

Figure 5:
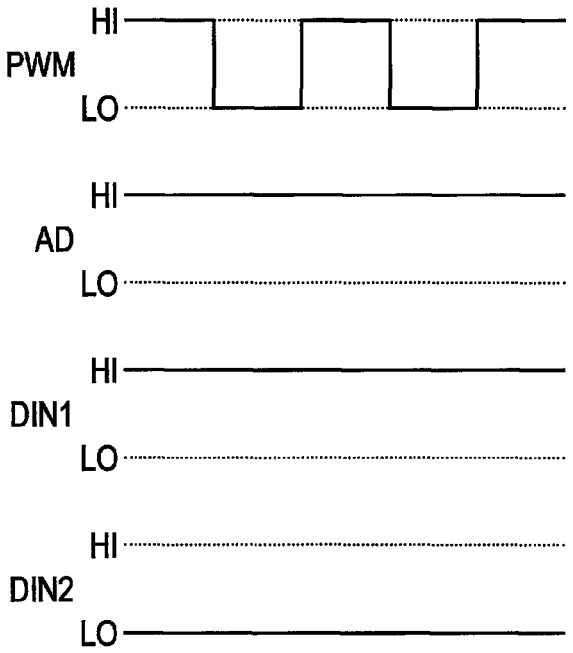
FIG. 5 is an explanatory diagram for explaining the second example of failure detection performed by the signal processing circuit that the light-emitting diode driving apparatus according to an embodiment of the present invention includes.

FIG. 5 illustrates the voltage levels of the voltages (the third voltage, the first voltage and the second voltage) to be respectively input into the terminal AD, the terminal DIN1 and the terminal DIN2 of the signal processing circuit 106 in a case where the short-circuit failure is occurring in the switching transistor Tr.

As described above, in a case where the short-circuit has occurred between the emitter and collector of the switching transistor Tr and the short-circuit failure has occurred in the switching transistor Tr, the switching transistor Tr becomes the on-state not depending on the pulse width modulation signal to be applied to the control terminal. Accordingly, in a case where the shirt-circuit failure has occurred in the switching transistor Tr, as illustrated in FIG. 5, the voltage level of the third voltage to be input into the terminal AD and the voltage level of the second voltage to be input into the terminal DIN2 are different from the voltage levels illustrated in FIG. 4.

Specifically, in a case where the short-circuit failure has occurred in the switching transistor Tr when the output state of the pulse width modulation signal is the state where the pulse width modulation signal for making the light-emitting diode LED emit light is being output, the switching transistor Tr becomes the on-state and thereby the voltage level of the third voltage to be input into the terminal AD and the voltage level of the second voltage to be input into the terminal DIN2 become the voltage levels as follows not depending on the pulse width modulation signal to be applied to the control terminal.

The voltage level of the third voltage to be input into the terminal AD becomes the high level.

The voltage level of the second voltage to be output from the comparison circuit 104 in which the threshold voltage is lower than that of the comparison circuit 102 becomes the low level.

For example, in a case where the "output state of the pulse width modulation signal" is the state where the pulse width modulation signal for making the light-emitting diode LED emit light is being output, the signal processing circuit 106 determines that the short-circuit failure has occurred in the switching transistor Tr when the "combination of the respective voltage levels of the first voltage, the second voltage and the third voltage" is the combination illustrated in FIG. 5. The signal processing circuit 106 detects the short-circuit failure in the switching transistor Tr by determining occurrence of the short-circuit failure in the switching transistor Tr, for example, in the above mentioned manner.

[1-2-2] Detection of the Open-Circuit Failure in the Switching Transistor Tr

Figure 6:
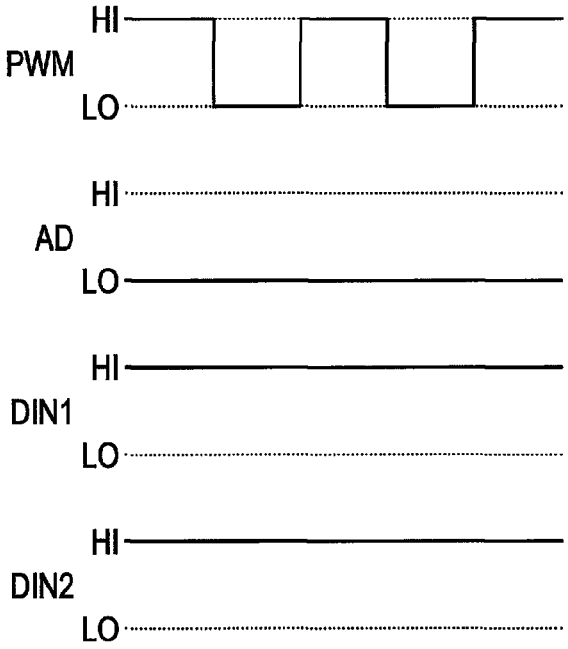
FIG. 6 is an explanatory diagram for explaining the second example of failure detection performed by the signal processing circuit that the light-emitting diode driving apparatus according to an embodiment of the present invention includes.

FIG. 6 illustrates the voltage levels of the voltages (the third voltage, the first voltage and the second voltage) to be respectively input into the terminal AD, the terminal DIN1 and the terminal DIN2 of the signal processing circuit 106 in a case where the open-circuit failure is occurring in the switching transistor Tr.

In a case where the open-circuit failure has occurred in the switching transistor Tr, the switching transistor Tr becomes the off-state not depending on the pulse width modulation signal to be applied to the control terminal. Accordingly, as illustrated in FIG. 6, in a case where the open-circuit failure has occurred in the switching transistor Tr, the voltage level of the third voltage to be input into the terminal AD and the voltage level of the second voltage to be input into the terminal DIN2 are different from the voltage levels illustrated in FIG. 4.

Specifically, in a case where the open-circuit failure has occurred in the switching transistor Tr when the output state of the pulse width modulation signal is the state where the pulse width modulation signal for making the light-emitting diode LED emit light is being output, the switching transistor Tr becomes the off-state and thereby the voltage level of the third voltage to be input into the terminal AD and the voltage level of the second voltage to be input into the terminal DIN2 become the voltage levels as follows not depending on the pulse width modulation signal to be applied to the control terminal.

The voltage level of the third voltage to be input into the terminal AD becomes the low level.

The voltage level of the second voltage to be output from the comparison circuit 104 in which the threshold voltage is lower than that of the comparison circuit 102 becomes the high level.

For example, in a case where the "output state of the pulse width modulation signal" is the state where the pulse width modulation signal for making the light-emitting diode LED emit light is being output, the signal processing circuit 106 determines that the open-circuit failure has occurred in the switching transistor Tr when the "combination of the respective voltage levels of the first voltage, the second voltage and the third voltage" is the combination illustrated in FIG. 6. The signal processing circuit 106 detects the open-circuit failure in the switching transistor Tr by determining occurrence of the open-circuit failure in the switching transistor Tr, for example, in the above-mentioned manner.

[1-2-3] Detection of the Short-Circuit Failure in the Light-Emitting Diode LED

Figure 7:
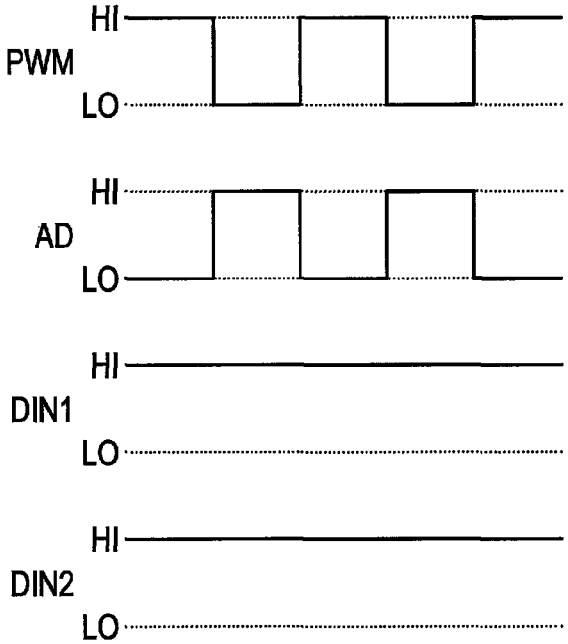
FIG. 7 is an explanatory diagram for explaining the second example of failure detection performed by the signal processing circuit that the light-emitting diode driving apparatus according to an embodiment of the present invention includes.

FIG. 7 illustrates the voltage levels of the voltages (the third voltage, the first voltage and the second voltage) to be respectively input into the terminal AD, the terminal DIN1 and the terminal DIN2 of the signal processing circuit 106 in a case where the short-circuit failure is occurring in the light-emitting diode LED.

In a case where the short-circuit has occurred between the anode and cathode of the light-emitting diode LED and the short-circuit failure has occurred in the light-emitting diode LED, a voltage drop by the light-emitting diode LED does not occur. Accordingly, as illustrated in FIG. 7, in a case where the short-circuit failure has occurred in the light-emitting diode LED, the voltage level of the second voltage to be input into the terminal DIN2 becomes different from the voltage level illustrated in FIG. 4.

Specifically, in a case where the short-circuit failure has occurred in the light-emitting diode LED when the output state of the pulse width modulation signal is the state where the pulse width modulation signal for making the light-emitting diode LED emit light is being output, the voltage level of the second voltage to be input into the terminal DIN2 becomes the voltage level as follows not depending on the pulse width modulation signal to be applied to the control terminal.

The voltage level of the second voltage to be output from the comparison circuit 104 in which the threshold voltage is lower than that of the comparison circuit 102 becomes the high level.

For example, in a case where the "output state of the pulse width modulation signal" is the state where the pulse width modulation signal for making the light-emitting diode LED emit light is being output, the signal processing circuit 106 determines that the short-circuit failure has occurred in the light-emitting diode LED when the "combination of the respective voltage levels of the first voltage, the second voltage and the third voltage" is the combination illustrated in FIG. 7. The signal processing circuit 106 detects the short-circuit failure in the light-emitting diode LED by determining occurrence of the short-circuit failure in the light-emitting diode LED, for example, in the above-mentioned manner.

[1-2-4] Detection of the Open-Circuit Failure in the Light-Emitting Diode LED

Figure 8:
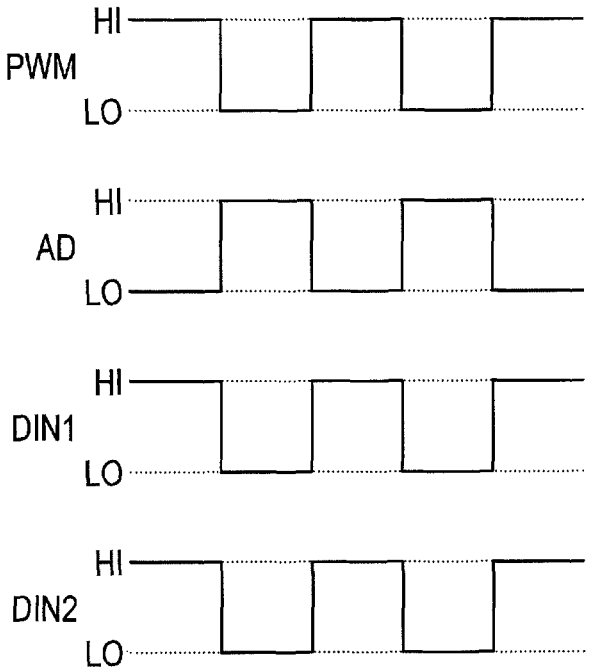
FIG. 8 is an explanatory diagram for explaining the second example of failure detection performed by the signal processing circuit that the light-emitting diode driving apparatus according to an embodiment of the present invention includes.

FIG. 8 illustrates the voltage levels of the voltages (the third voltage, the first voltage and the second voltage) to be respectively input into the terminal AD, the terminal DIN1 and the terminal DIN2 of the signal processing circuit 106 in a case where the open-circuit failure is occurring in the light-emitting diode LED.

In a case where the open-circuit failure has occurred in the light-emitting diode LED, a resistance value of the light-emitting diode LED is greatly increased and therefore almost no electric current flows in the light-emitting diode LED in accordance with Ohm's law. Accordingly, in a case where the open-circuit failure has occurred in the light-emitting diode LED, as illustrated in FIG. 8, the voltage level of the first voltage to be input into the terminal DIN1 becomes different from the voltage level illustrated in FIG. 4.

Specifically, in a case where the open-circuit failure has occurred in the light-emitting diode LED when the output state of the pulse width modulation signal is the state where the pulse width modulation signal for making the light-emitting diode LED emit light is being output, the voltage level of the first voltage to be input into the terminal DIN1 becomes the voltage level as follows.

The voltage level of the first voltage to be output from the comparison circuit 102 changes in accordance with a signal level of the pulse width modulation signal to be applied to the control terminal.

For example, in a case where the "output state of the pulse width modulation signal" is the state where the pulse width modulation signal for making the light-emitting diode LED emit light is being output, the signal processing circuit 106 determines that the open-circuit failure has occurred in the light-emitting diode LED when the "combination of the respective voltage levels of the first voltage, the second voltage and the third voltage" is the combination illustrated in FIG. 8. The signal processing circuit 106 detects the open-circuit failure in the light-emitting diode LED by determining occurrence of the open-circuit failure in the light-emitting diode LED, for example, in the above-mentioned manner.

For example, as exemplified in the first example in the above-mentioned item [1-1] and the second examples (the above-mentioned items [1-2-1] to [1-2-4]) in the above-mentioned item [1-2], it is possible for the signal processing circuit 106 to detect occurrence of each of the short-circuit failure in the switching transistor Tr, the open-circuit failure in the switching transistor Tr, the short-circuit failure in the light-emitting diode LED and the open-circuit failure in the light-emitting diode LED on the basis of the "output state of the pulse width modulation signal" and the "combination of the respective voltage levels of the first voltage, the second voltage and the third voltage".

Incidentally, processing in the signal processing circuit 106 is not limited to such processing relevant to detection of the failures in the light-emitting diode LED and the switching transistor Tr as mentioned above.

It is possible for the signal processing circuit 106 to further perform processing relevant to, for example, light emission control of the light-emitting diode LED.

In a case where the processing relevant to light emission control is to be performed, the signal processing circuit 106 controls light emission of the light-emitting diode LED, for example, by generating the pulse width modulation signal and outputting it to the switching transistor Tr. In a case where the light-emitting diode driving apparatus 100 is configured as, for example, an apparatus relevant to notification of a state of a system (or an apparatus) such as an apparatus relevant to an indicator for notifying a state of a vehicle such as an automobile, the signal processing circuit 106 visually notifies a user of the state of the system by generating the pulse width modulation signal and thereby making the light-emitting diode LED emit light in accordance with the state of the system.

In addition, it is also possible for the signal processing circuit 106 to further perform, for example, notification control processing for notification of detection of the failure.

In a case where the failure has been detected, the signal processing circuit 106 transmits, for example, a sound signal (a warning sound and music are also included) which indicates occurrence of the failure to a sound output device such as a loudspeaker. The sound output device may be either a device that the light-emitting diode driving apparatus 100 includes or an external device which is connected to the light-emitting diode driving apparatus 100.

The above-mentioned sound output device outputs the sound indicating occurrence of the failure and thereby, for example, the user of the light-emitting diode driving apparatus 100 and others are audibly notified of occurrence of the failure in the light-emitting diode driving apparatus 100 and the contents of the failure having occurred.

In addition, the signal processing circuit 106 makes a communication device transmit data indicating the contents of the failure having occurred to, for example, an external device such as a server of a manufacturer of the light-emitting diode driving apparatus 100. That is, the signal processing circuit 106 makes, for example, a communication device that the light-emitting diode driving apparatus 100 includes, or an external communication device which is connected to the light-emitting diode driving apparatus 100 transmit the data indicating the contents of the failure having occurred. The communication device transmits the data indicating the contents of the failure having occurred via radio communication or cable communication.

Examples of the communication device according to an embodiment of the present invention include a communication antenna and a radio frequency (RF) circuit (radio communication), an IEEE802.15.1 port and a transmission/reception circuit (radio communication), an IEEE802.11 port and a transmission/reception circuit (radio communication), and a local area network (LAN) terminal and a transmission/reception circuit (cable communication).

The communication device transmits the data indicating the contents of the failure having occurred to the external device and thereby it becomes possible for the user (for example, a person in charge of maintenance of the manufacturer of the light-emitting diode driving apparatus 100) of the external device to recognize the failure detected in the light-emitting diode driving apparatus 100.

The signal processing circuit 106 performs such processing, for example, as mentioned above as notification control processing. Incidentally, the notification control processing according to an embodiment of the present invention is not limited to the above-mentioned examples. For example, it is possible for the signal processing circuit 106 to perform processing relevant to any notification method by which notification of detection of the failure becomes possible such as, for example, a tactile notification method by vibrating a vibration device in a case where the failure has been detected.

The light-emitting diode driving apparatus according to an embodiment of the present invention has the configuration illustrated in, for example, FIG. 1.

Incidentally, the configuration of the light-emitting diode driving apparatus according to an embodiment of the present invention is not limited to the configuration illustrated in FIG. 1.

The light-emitting diode driving apparatus according to an embodiment of the present invention may further include, for example, the signal output circuit (not illustrated) which generates and outputs the pulse width modulation signal.

The signal output circuit (not illustrated) generates the pulse width modulation signal by performing processing relevant to, for example, the light emission control of the light-emitting diode LED. Then, the signal output circuit (not illustrated) outputs the generated pulse width modulation signal to the switching transistor Tr.

In addition, the signal output circuit (not illustrated) transmits data indicating the output state of the pulse width modulation signal to the signal processing circuit 106.

In a case where the signal output circuit (not illustrated) is provided, the signal processing circuit 106 detects the failure in each of the light-emitting diode LED and the switching transistor Tr on the basis of the output state of the pulse width modulation signal which is indicated by the above-mentioned data indicating the output state of the pulse width modulation signal.

[2] Advantageous Effects that the Light-Emitting Diode Driving Apparatus According to an Embodiment of the Present Invention Exhibits One example of the advantageous effects that the light-emitting diode driving apparatus according to an embodiment of the present invention exhibits will be described by taking the light-emitting diode driving apparatus 100 illustrated in FIG. 1 by way of example.

In the light-emitting diode driving apparatus 100, as described above, the signal processing circuit 106 detects the failure having occurred in the light-emitting diode on the basis of the output state of the pulse width modulation signal, the first voltage, the second voltage and the third voltage. Accordingly, as described in the above-mentioned item [1-2-3] and the above-mentioned item [1-2-4], even in a case where the short-circuit failure or the open-circuit failure has occurred in the light-emitting diode LED which is emitting light by being driven by pulse width modulation, it is possible for the light-emitting diode driving apparatus 100 to detect each of the short-circuit failure and the open-circuit failure in the light-emitting diode LED.

Accordingly, it is possible for the light-emitting diode driving apparatus 100 to detect the failure (the open-circuit failure or the short-circuit failure) having occurred in the light-emitting diode LED which emits light by being driven by pulse width modulation.

In addition, in the light-emitting diode driving apparatus 100, it is possible for the signal processing circuit 106 to further detect the failure having occurred in the switching transistor Tr on the basis of the output state of the pulse width modulation signal, the first voltage, the second voltage and the third voltage. Accordingly, as described in the above-mentioned item [1-1], the above-mentioned item [1-2-1] and the above-mentioned item [1-2-2], it is possible for the light-emitting diode driving apparatus 100 to detect each of the short-circuit failure and the open-circuit failure in the switching transistor Tr.

In addition, as described above, since each of the short-circuit failure in the light-emitting diode LED, the open-circuit failure in the light-emitting diode LED, the short-circuit failure in the switching transistor Tr and the open-circuit failure in the switching transistor Tr is detected on the basis of the output state of the pulse width modulation signal, the first voltage, the second voltage and the third voltage, it becomes possible for the light-emitting diode driving apparatus 100 to rapidly detect the failure having occurred.

In addition, when the notification control processing is performed in the signal processing circuit 106, it becomes possible for the light-emitting diode driving apparatus 100 to rapidly notify the user of the light-emitting diode driving apparatus 100, the user of the external device or others of the failure detected.

Although, in the foregoing, description has been made by taking the light-emitting diode driving apparatus as an embodiment of the present invention, the embodiment of the present invention is not limited to the above-mentioned one embodiment. The embodiment of the present invention is also applicable to various systems and various pieces of equipment each including the light-emitting diode which emits light by being driven by pulse width modulation such as, for example, vehicles such as cars (or parts of a vehicle system such as an indicator part constituting the vehicle system and so forth), communication devices such as mobile phones and smartphones, tablet-type devices, television receivers, computers such as personal computers (PCs) and so forth.

In addition, although, in the foregoing, description has been made by taking the apparatus which includes the light-emitting diode as illustrated in FIG. 1 as an embodiment of the present invention, it is also possible to replace the light-emitting diode illustrated in HG. 1 with "any structural element which is controlled by being driven by pulse width modulation such that the electric current flows to induce the voltage drop (any structural element which is controlled by being driven by pulse width modulation such that a normal function that the structural element has works to induce the voltage drop)".

It is also possible for an apparatus in which the light-emitting diode illustrated in FIG. 1 has been replaced with the above-mentioned structural element to detect each of the failures in the above-mentioned structural element and the switching transistor Tr on the basis of the output state of the pulse width modulation signal, the first voltage, the second voltage and the third voltage similarly to the light-emitting diode driving apparatus 100 illustrated in FIG. 1. In addition, it is possible for the apparatus in which the light-emitting diode illustrated in FIG. 1 has been replaced with the above-mentioned structural element to exhibit the same advantageous effects as those of the light-emitting diode driving apparatus 100 illustrated in FIG. 1.

Heretofore, preferred embodiments of the present invention have been described in detail with reference to the appended drawings, but the present invention is not limited thereto. It should be understood by those skilled in the art that various changes and alterations may be made without departing from the spirit and scope of the appended claims.

What is claimed is:

1. A light-emitting diode driving apparatus, comprising:

a switching transistor which has a first terminal electrically connected with a power source and becomes an on-state or an off-state in response to a pulse width modulation signal applied to a control terminal;

a light-emitting diode which is electrically connected with a second terminal of the switching transistor and emits light when an electric current flows;

a first comparison circuit which is electrically connected between the switching transistor and the light-emitting diode and outputs a first voltage depending on a result of comparison between a first input voltage corresponding to a voltage applied to the light-emitting diode and a first threshold voltage;

a second comparison circuit which is electrically connected between the switching transistor and the light-emitting diode and outputs a second voltage depending on a result of comparison between a second input voltage corresponding to a voltage applied to the light-emitting diode and a second threshold voltage different from the first threshold voltage; and a signal processing circuit which detects a failure having occurred in the light-emitting diode on the basis of an output state of the pulse width modulation signal, the first voltage, the second voltage and a third voltage on the second terminal side of the switching transistor.

2. The light-emitting diode driving apparatus according to claim 1, wherein the signal processing circuit detects occurrence of each of a short-circuit failure in the light-emitting diode and an open-circuit failure in the light-emitting diode on the basis of the output state of the pulse width modulation signal and a combination of respective voltage levels of the first voltage, the second voltage and the third voltage.

3. The light-emitting diode driving apparatus according to claim 2, wherein the signal processing circuit further detects a failure which has occurred in the switching transistor on the basis of the output state of the pulse width modulation signal, the first voltage, the second voltage and the third voltage.

4. The light-emitting diode driving apparatus according to claim 3, wherein the signal processing circuit detects occurrence of each of a short-circuit failure in the switching transistor and an open-circuit failure in the switching transistor on the basis of the output state of the pulse width modulation signal and a combination of respective voltage levels of the first voltage, the second voltage and the third voltage.

5. The light-emitting diode driving apparatus according to claim 4, wherein the signal processing circuit outputs the pulse width modulation signal.

6. The light-emitting diode driving apparatus according to claim 4, further comprising:

a signal output circuit which generates and outputs the pulse width modulation signal, wherein the signal processing circuit detects a failure having occurred in the light-emitting diode on the basis of the output state of the pulse width modulation signal in the signal output circuit.

7. The light-emitting diode driving apparatus according to claim 3, wherein the signal processing circuit outputs the pulse width modulation signal.

8. The light-emitting diode driving apparatus according to claim 3, further comprising:

a signal output circuit which generates and outputs the pulse width modulation signal, wherein the signal processing circuit detects a failure having occurred in the light-emitting diode on the basis of the output state of the pulse width modulation signal in the signal output circuit.

9. The light-emitting diode driving apparatus according to claim 2, wherein the signal processing circuit outputs the pulse width modulation signal.

10. The light-emitting diode driving apparatus according to claim 2, further comprising:

a signal output circuit which generates and outputs the pulse width modulation signal, wherein the signal processing circuit detects a failure having occurred in the light-emitting diode on the basis of the output state of the pulse width modulation signal in the signal output circuit.

11. The light-emitting diode driving apparatus according to claim 1, wherein the signal processing circuit further detects a failure which has occurred in the switching transistor on the basis of the output state of the pulse width modulation signal, the first voltage, the second voltage and the third voltage.

12. The light-emitting diode driving apparatus according to claim 11, wherein the signal processing circuit detects occurrence of each of a short-circuit failure in the switching transistor and an open-circuit failure in the switching transistor on the basis of the output state of the pulse width modulation signal and a combination of respective voltage levels of the first voltage, the second voltage and the third voltage.

13. The light-emitting diode driving apparatus according to claim 12, wherein the signal processing circuit outputs the pulse width modulation signal.

14. The light-emitting diode driving apparatus according to claim 12, further comprising:

a signal output circuit which generates and outputs the pulse width modulation signal, wherein the signal processing circuit detects a failure having occurred in the light-emitting diode on the basis of the output state of the pulse width modulation signal in the signal output circuit.

15. The light-emitting diode driving apparatus according to claim 11, wherein the signal processing circuit outputs the pulse width modulation signal.

16. The light-emitting diode driving apparatus according to claim 11, further comprising:

a signal output circuit which generates and outputs the pulse width modulation signal, wherein the signal processing circuit detects a failure having occurred in the light-emitting diode on the basis of the output state of the pulse width modulation signal in the signal output circuit.

17. The light-emitting diode driving apparatus according to claim 1, wherein the output state of the pulse width modulation signal is a state where the pulse width modulation signal for making the light-emitting diode emit light is output or a state where the pulse width modulation signal for stopping light emission of the light-emitting diode is output.

18. The light-emitting diode driving apparatus according to claim 1, wherein the signal processing circuit outputs the pulse width modulation signal.

19. The light-emitting diode driving apparatus according to claim 1, further comprising:

a signal output circuit which generates and outputs the pulse width modulation signal, wherein the signal processing circuit detects a failure having occurred in the light-emitting diode on the basis of the output state of the pulse width modulation signal in the signal output circuit.

* * * * *